US005323621A

United States Patent [19]

Subera et al.

[11] Patent Number: 5,323,621

[45] Date of Patent: Jun. 28, 1994

[54] GAS DEFROST SYSTEM

[75] Inventors: Elmer J. Subera, Cassopolis, Mich.; Michael J. Schuetter, South Bend, Ind.

[73] Assignee: Tyler Refrigeration Corporation, Niles, Mich.

[21] Appl. No.: 23,086

[22] Filed: Feb. 26, 1993

[51] Int. Cl.[5] ..... F25D 21/02

[52] U.S. Cl. ..... 62/196.4; 62/234; 62/278

[58] Field of Search ..... 62/81, 155, 152, 196.4, 62/234, 277, 278

[56] References Cited

U.S. PATENT DOCUMENTS

| | | | |
|---|---|---|---|
| 2,978,877 | 4/1961 | Long | 62/278 X |
| 3,464,226 | 9/1969 | Kramer | 62/278 X |
| 4,151,723 | 5/1979 | Gardner | 62/155 |
| 4,318,277 | 3/1982 | Cann et al. | 62/278 |
| 4,437,317 | 3/1984 | Ibrahim | 62/152 X |

FOREIGN PATENT DOCUMENTS

| | | | |
|---|---|---|---|
| 0104057 | 8/1979 | Japan | 62/278 |

*Primary Examiner*—Harry B. Tanner

*Attorney, Agent, or Firm*—James D. Hall

[57] ABSTRACT

A gas defrost apparatus for melting frost and ice from evaporators in commercial refrigeration systems using a pressure differential hold back valve to direct superheated refrigerant in a reversed direction into the evaporators and a gas return conduit for reintroducing the refrigerant into the main refrigerant distribution system between the compressors and condensers. Reintroducing the refrigerant on the high side of the condensers between the compressors and condensers prevents inefficiencies in the refrigeration system.

10 Claims, 1 Drawing Sheet

GAS DEFROST SYSTEM

This invention relates generally to an improvement in defrost systems in commercial refrigeration units and will have particular application to a gas defrost system.

BACKGROUND OF THE INVENTION

Gas defrost systems are common in commercial refrigeration devices to melt ice and frost accumulating on the evaporators. Generally, gas defrost systems redirect the superheated refrigerant discharge vapor from the compressors in a reversed direction through the evaporators. Recirculating the superheated refrigerant vapor defrosts the evaporators with the vapor desuperheating and condensing before exiting the evaporators. The refrigerant is then reintroduced into the main liquid distribution system at the liquid supply manifold or at the receiver tank of the refrigeration system.

The greater portion of the defrosting is accomplished through the latent process of condensation rather than a sensible heat exchange. In the latter stages of the .defrost cycle, the temperature differential between the refrigerant and evaporator decreases; therefore, not all of the refrigerant undergoes a complete phase change. Consequently, the refrigerant reentering the liquid distribution system has a mixed-phase condition, part liquid and part vapor. Since the main liquid distribution system is still feeding liquid refrigerant to other branch circuits (multiple evaporators) in the cooling mode, the reintroduction of a two phase refrigerant to the main liquid distribution system during the defrosting operation results in temporary inefficiencies. The dual phase refrigerants also causes the compressors to pump longer and harder during a defrost cycle and can also temporarily elevate cabinet temperatures.

SUMMARY OF THE INVENTION

The gas defrosting system of this invention prevents the inefficiencies caused by the reintroduction of the dual phase refrigerant in the main liquid distribution system by returning the refrigerant from the evaporators to the main condenser inlet conduit. Reintroducing such refrigerant into the condenser inlet conduit allows the intended condenser process to complete the phase change of the refrigerant to liquid before it enters the main liquid distribution system.

The gas defrost system of this invention uses a pressure differential valve located between the compressors and the condensers and a connecting conduit line from the gas return manifold into the condenser inlet conduit. During a defrost period, the pressure differential valve causes a reduced pressure downstream to allow the two phase refrigerant to enter into the pipe to the condenser inlet.

An object of this invention is to provide a novel and unique gas defrost system for use in a commercial refrigeration system.

Another object is to provide an integral gas defrost system that returns the refrigerant from the evaporator during the defrost mode into the main liquid distribution system between the compressors and condensers.

Other objects will become apparent upon reading the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
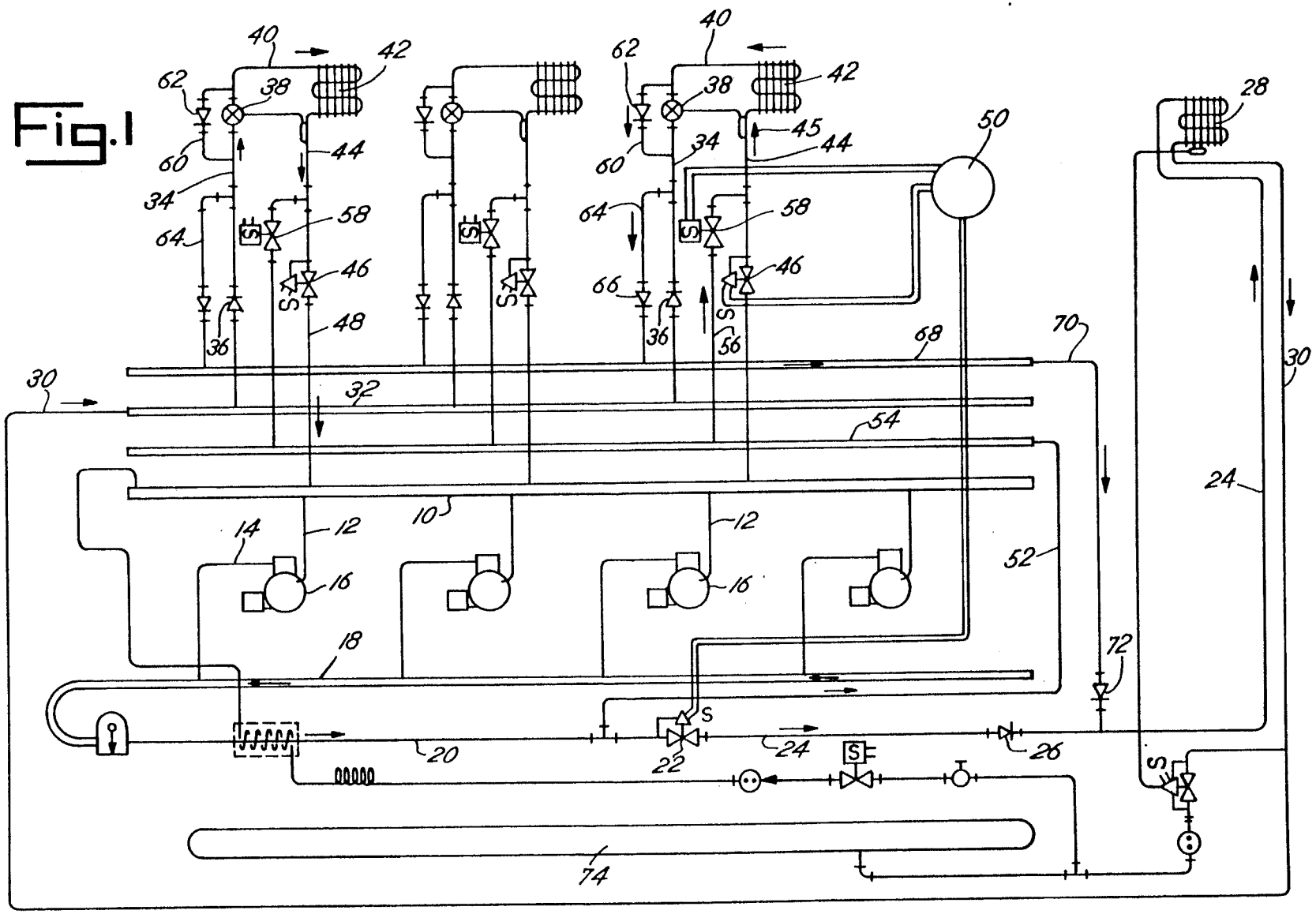
FIG. 1 is a schematic drawing of the refrigeration system with the gas defrost system of this invention using multiple compressors and evaporators.

The preferred embodiment herein described is not intended to be exhaustive or to limit the invention to the precise form disclosed. It is chosen and described to explain the principles of the invention and its application and practical use to enable others skilled in the art to utilize its teachings.

The basic configuration of the refrigeration system of this invention includes the conventional components of a refrigeration cycle, i.e. compressors, condensers, evaporators, a receiver and expansion valves. As commonly known in the art, commercial refrigeration systems may incorporate multiple compressors, evaporators and condensers in parallel. These constructions and their configurations are well known in the art. Also, it will be understood that the invention hereinafter described is not dependent upon the number or size of such components.

The figure shows the basic layout of the refrigeration system. The refrigeration mode is illustrated by the flow arrows shown for the evaporator 42 shown at the far left of FIG. 1. Starting at the suction manifold 10, the refrigerant or coolant is found as a vapor. The compressors 16 draw refrigerant vapor from suction manifold 10 through compressor inlet conduit 12 and outlet conduit 14. As commonly known in the field, one or more compressors can be used in parallel and operated independently. Compressors 16 discharge a highly pressurized superheated refrigerant vapor through outlet conduit 14 into a discharge manifold 18. From discharge manifold 18, the superheated refrigerant vapor moves through outlet conduit 20 to a hot gas differential valve 22.

Hold back valve 22 is of conventional design and can be either an electric inlet pressure regulator, electric differential pressure regulator or a solenoid valve. For simplicity, a differential pressure regulator will be used in this description. Pressure differential hold back valve 22 operates between an open position and hold back position. Hold back valve 22 senses the pressure differential between the upstream high pressure from compressors 16 and the downstream pressure to the condensers 28. Hold back valve 22 is set to actuate within a specific range of differential pressures. In the refrigeration mode, hold back valve 22 is open and the superheated vapor passes through the valve from outlet conduit 20 into condenser inlet conduit 24. Condenser inlet conduit 24 includes a check valve 26 to prevent refrigerant from moving backwards through valve 22.

The refrigerant vapor enters the condensers 28 through condenser inlet conduit line 24. Typically, condensers 28 will be placed in some exterior location so as to be exposed to ambient air which in passing through the condensers will provide subcooling of the refrigerant circulating through the condenser. At this time, the refrigerant undergoes a phase change from vapor to liquid. The liquid refrigerant then passes out of condenser 28 through liquid conduit line 30 into liquid supply manifold 32.

As common practice in commercial refrigeration systems, multiple evaporators 42 draw liquid refrigerant from a liquid supply manifold 32. For each evaporator 42, the liquid refrigerant passes through a conduit 34 and an expansion valve 38. Inlet conduit line 34 includes a check valve 36 to prevent a reversed flow of the two phase refrigerant into liquid supply manifold 32 during the defrost cycle. The liquid refrigerant passes from expansion valve 38 into evaporator 42 through conduit 40. A refrigerant phase change from liquid to vapor takes place within each evaporator 42. The refrigerant vapor then passes through conduit 44 and an electric evaporator pressure regulator (EPR) or another solenoid valve 46. In the refrigeration mode, the valve 46 is open or modulating. Refrigerant vapor passes from valve 46 through suction manifold inlet conduit 48, returning to suction manifold 10 to begin the cycle again.

The refrigeration system of this invention also incorporates a receiver removed from the refrigerant flow path and a valve system for metering refrigerant in the flow path during critical periods of operation. This type of receiver and refrigerant supply control is disclosed in U.S. Pat. No. 5,670,705 granted to David M. Goodson, et al. and is incorporated herein by reference.

The defrost system of this invention uses a gas defrosting mechanism to defrost and melt the accumulated frost and ice from the evaporators 42. As is common practice in the field of commercial refrigeration, generally only one or one group of evaporators will be defrosted at any one time while the remaining evaporators continue in the refrigeration cycle.

The defrosting cycle is controlled by a conventional mechanical or electronic defrost control clock 50, which triggers the order in which each evaporator 42 will be defrosted. Control clock 50 is shown connected to only one evaporator for illustrative purposes. But it is to be understood that clock 50 and its controls will be similarly associated with each evaporator 42 electrically coupled with hold back valve 22 and solenoid valves 46 and 58 of each evaporator 42.

In the defrost mode, compressors 16 again draw refrigerant vapor from suction manifold 10 through compressor conduit 12. The superheated refrigerant vapor (high pressure and high temperature) is pumped into discharge manifold 18. The superheated refrigerant vapor moves from discharge manifold conduit 18 into outlet conduit 20.

The defrost operation is controlled by control clock 50. Control clock 50 triggers each evaporator 42 to be defrosted in a particular sequence and duration. Conventional control clocks are preferably adjustable and can be set to accommodate multiple evaporators and various operating conditions. Control clock 50 is electrically connected to hold back valve 22 and solenoid valves 46 and 58.

In the defrost mode as illustrated by the flow arrows shown for the evaporator 42 shown at the far right in FIG. 1, control clock 50 energizes hold back valve 22 to reduce the downstream pressure within the user defined pressure ranges. By restricting the flow of refrigerant, hold back valve 22 allows the heated dual phase refrigerant in the liquid return manifold 68 to enter condenser inlet conduit 24. Consequently, hold back valve 22 redirects the passage of the superheated vapor through conduit 52 into hot gas manifold 54. For any evaporator 42 to be defrosted, control clock 50 switches solenoid valve 46 into a closed position and solenoid valve 58 in hot gas bypass conduit 56 into an open position. With solenoid valve 46 closed, the superheated vapor travels through hot gas bypass conduit 56 into conduit 44.

The superheated refrigerant vapor enters evaporator 42 through conduit 44 as shown by arrow 45 from the opposite direction as in the cooling mode. The temperature gradient within the evaporator condenses the vapor into a partial liquid. The heat generated during the phase change is conducted to the tube surfaces of the evaporator and melts the accumulated frost and ice on the tubes' surfaces. Near the end of the defrost cycle the temperature gradient decreases and not all of the resulting refrigerant undergoes the full phase change before the refrigerant exits the evaporator. Consequently, the exiting refrigerant exiting evaporator 42 moving through conduit 40 is a combination of two phase states, liquid and vapor.

The refrigerant exiting the evaporator bypasses expansion valve 38 by passing through outlet conduit 60 into conduit 34. Bypass conduit 60 includes a check valve 62 to prevent back flow of the refrigerant into evaporator 42. Forced by check valve 36, the dual phase refrigerant branches again into bypass conduit 64 and empties into liquid return manifold 68. Conduit 64 also contains a check valve 66 to insure one directional flow into liquid return manifold 68. The dual phase refrigerant moves from liquid return manifold 68 through outlet conduit 70 into inlet conduit 24 of condenser 28. Outlet conduit 70 contains a check valve 72, which prevents refrigerant moving from hold back valve 22 back into liquid return manifold 68. Passing through condenser 28 completes the phase change of the refrigerant into liquid.

It is understood that the above description does not limit the invention to the details given, but may be modified within the scope of the following claims.

I claim:

1. A refrigeration system with an integral defrost system comprising compressor means for superheating a refrigerant within said system; condenser means for affecting a phase change in said refrigerant from vapor to liquid within said condenser means; and evaporator means shiftable between a cooling mode and a defrost mode affecting a phase change in the refrigerant within said evaporator means from liquid to vapor in said cooling mode and from vapor to generally a liquid in said defrost mode; said compressor means, condenser means and evaporator means interconnected in series by conduit means including a first conduit connecting said compressor means and said condenser means for communicating said superheated refrigerant from the compressor means to the condenser means; valve means within said first conduit and switchable between an open position when said evaporate means is in its said cooling mode and a holdback position when said evaporator means is in its said defrost mode; a second conduit connected to said first conduit between said compressor means and said valve means and extending to said evaporator means for communicating the superheated refrigerant from the compressor means into the evaporator means when the evaporator means is in its said defrost mode; said valve means when in its holdback position for causing a pressure difference between refrigerant upstream and downstream of said valve means within the first conduits wherein at least a portion of said superheated refrigerant passes into said second conduit; and a conduit extending from said evaporator means and connected to said first conduit between said valve means and said condenser means for communicating refrigerant to the condenser means from the evaporator means when the evaporator means is in its said defrost mode.

2. The system of claim 1 further includes control means for shifting and evaporator means between its said cooling and defrost modes and for switching said valve means between its said open and holdback positions.

3. The system of claim 2 wherein said control means includes a timer means responsive to time operatively connected to said evaporator means and said valve means.

4. The system of claim 1 wherein said evaporator means includes an evaporator unit; said evaporator unit includes an outlet part connected to said compressor means, a bypass part connected to said evaporator outlet part between said unit and the compressor means forming a portion of said second conduit, and second valve means operatively associated with said outlet part and said bypass part for communicating vapor refrigerant through the outlet part from the evaporator unit to the compressor means when said evaporator means is in its said cooling mode and for communicating superheated refrigerant from the compressor means through the bypass part into the evaporator unit when said evaporator means is in its said defrost mode.

5. The system of claim 4 wherein said second valve means includes a main valve within said outlet part shiftable between an open and closed position and a bypass valve within said bypass part shiftable between an open and closed position; said main valve being in its said open position when said bypass valve in its said closed position thereby defining said cooling mode of said evaporator means; the main valve in its said closed position when the bypass valve in its said open position thereby defining said defrost mode of the evaporator means.

6. The system of claim 4 wherein said evaporator unit also includes an inlet part forming a portion of said conduit means for communicating liquid refrigerant from said condenser means into said evaporator unit; said third conduit connected to said inlet part.

7. The system of claim 6 wherein said evaporator means includes a second said evaporator unit and a supply manifold, each evaporator unit connected to said supply manifold by their inlet parts for communicating liquid refrigerant to each evaporator unit said supply manifold connected to said condenser means to form part of said conduit means.

8. The system of claim 7 wherein said compressor means includes a plurality of compressor units each having an inlet part and outlet part; a suction manifold for communicating refrigerant from each evaporator unit with each compressor unit; and a discharge manifold connected to said first conduit for communicating superheated refrigerant from each compressor unit into said first conduit; said compressor units connected in parallel to said suction manifold by their respective inlet parts and to said discharge manifold by their respective outlet parts; said evaporator units connected in parallel to the suction manifold by their respective outlet parts.

9. The system of claim 7 wherein said third conduit includes a return manifold connected to each evaporator unit for communicating vapor refrigerant from each evaporator unit to said first conduit, each evaporator unit also includes a second bypass part connected to its inlet part between the evaporator unit and said supply manifold and extending to said return manifold.

10. The system of claim 7 wherein said second conduit includes a hot gas manifold, each evaporator unit connected to said hot gas manifold by its said bypass part for communicating said superheated refrigerant to each evaporator unit.

* * * * *